US008469234B1

(12) United States Patent
Loomis

(10) Patent No.: US 8,469,234 B1
(45) Date of Patent: Jun. 25, 2013

(54) TOY WATER GUN APPARATUS

(75) Inventor: Jason Loomis, Decatur, GA (US)

(73) Assignee: Loominocity Inc., Napa, CA (US)

( * ) Notice: Subject to any disclaimer, the term of this patent is extended or adjusted under 35 U.S.C. 154(b) by 530 days.

(21) Appl. No.: 12/572,735

(22) Filed: Oct. 2, 2009

(51) Int. Cl.
*A63H 33/00* (2006.01)

(52) U.S. Cl.
USPC ..... 222/79; 222/95; 222/386.5

(58) Field of Classification Search
USPC ..... 222/79, 78, 399, 92, 95, 105, 206, 222/207, 209, 214, 386.5
See application file for complete search history.

(56) References Cited

U.S. PATENT DOCUMENTS

| | | | | |
|---|---|---|---|---|
| 3,055,553 | A * | 9/1962 | Mapes et al. | 222/95 |
| 4,854,480 | A * | 8/1989 | Shindo | 222/79 |
| 4,867,208 | A * | 9/1989 | Fitzgerald et al. | 141/18 |
| 5,531,627 | A * | 7/1996 | Deal | 446/473 |
| 5,850,941 | A * | 12/1998 | Johnson et al. | 222/79 |
| 5,915,771 | A * | 6/1999 | Amron | 222/79 |
| 6,193,107 | B1 * | 2/2001 | D'Andrade | 222/79 |
| 6,325,246 | B1 * | 12/2001 | Crawford et al. | 222/79 |
| 7,131,557 | B2 * | 11/2006 | Zimmerman et al. | 222/79 |
| 7,185,787 | B2 * | 3/2007 | Brown et al. | 222/79 |
| 7,753,239 | B2 * | 7/2010 | Chang | 222/394 |
| 2005/0184098 | A1 * | 8/2005 | Dixon | 222/192 |
| 2008/0030024 | A1 * | 2/2008 | Parrott | 285/276 |

* cited by examiner

*Primary Examiner* — Kevin P Shaver
*Assistant Examiner* — Donnell Long
(74) *Attorney, Agent, or Firm* — Thompson Patent Law Offices PC; Craige Thompson

(57) ABSTRACT

A toy water gun apparatus includes a gun housing having a water chamber and a pressurized air chamber in fluid communication with the water chamber. The water chamber preferably includes an expandable bladder for filling with a quantity of water and has a first end and a second end, the first end connected to a water inlet for releasable connection to source of pressurized water such as a municipal water supply, and the second end connected to a nozzle valve. A trigger mechanism is connected to the nozzle valve to selectively open the valve to dispense a stream of water during play. The apparatus utilizes the naturally high pressure of a common faucet tap while the eliminating the necessity of constant pumping in order to maintain a desirable water stream. Pressure in the air chamber is never lost because it is entirely separate from the water-delivery mechanism.

10 Claims, 1 Drawing Sheet

TOY WATER GUN APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to games and toys, and more particularly to an improved toy water gun apparatus.

BACKGROUND INFORMATION AND DISCUSSION OF RELATED ART

'Super Soaker' type toy water guns lose pressure quickly and require constant re-pumping to maintain an effective water stream. Further, the duration of their effective water stream is brief and, therefore, the water play action is brief and punctuated by static periods of pumping. By necessity, this creates a continuous cycle of short blasts of effective water streams followed by furious pumping in order to recharge the gun.

The ordinary 'Super Soaker'-type guns, utilizing pump-action technology, provide the user with only a 2-3 second window to shoot water at their opponent. Then the user has to beat a hasty retreat while frantically pumping their water gun to re-charge it for another attack.

U.S. Pat. No. 4,257,460 to Paranay, et al. discloses a water gun having a body formed with a central bore opening at its opposite ends to provide a discharge nozzle at one end of the body and a storage compartment or reservoir end at the opposite end of the body. The storage compartment end is adapted to releasably hold the end of an inflatable member which when loaded with water under pressure, expands so as to stretch the membrane of the inflatable storage compartment. Upon termination of the loading pressure, the inflatable member collapses under its own elasticity to discharge the stored water via the nozzle end of the body. A clamping device is employed for detachably connecting the inflatable storage compartment to its respective end of the body and a trigger mechanism may be employed for selectively releasing the pressurized water within the storage compartment.

U.S. Pat. No. 4,854,480 to Shindo describes a long range trigger-actuated squirt gun. The squirt gun includes a hollow housing in the form of a gun with a liquid dispensing assembly within the housing. The liquid dispensing assembly includes a rubber tube, expandable upon being filled with liquid, which is connected to a rigid tube with a nozzle at one end, and will dispense liquid from the rubber tube through the nozzle. A pivotable trigger is mounted with one end located to squeeze the rubber tube against the housing. A rigid coil around the rubber tube between the trigger and rigid tube restrains the rubber tube from expansion for the length of the coil. An adapter is provided which is threadable on a faucet, for filling the rubber tube in the squirt gun with water.

U.S. Pat. No. 4,867,208 to Fitzgerald, et al. teaches an apparatus capable of storing and expelling a large quantity of fluid, having an elastic hollow tube having an open end through which fluid may be inserted into and expelled out of the tube; a hollow elongate outer enclosure surrounding the tube, and a slidable inner sleeve located between the tube and the outer enclosure. The inner sleeve slides through the outer tube upon contact by the tube as the tube axially expands, thereby preventing crimping of the tube.

U.S. Pat. No. 5,531,627 to Deal discloses a cartridge-type water bomb water gun conversion device which utilizes a cartridge-type water bomb which can be used by itself to release a burst of water or be inserted into a water gun which can convert the cartridge-type water bomb into a reservoir of pressurized water for discharge through an orifice producing a "squirt" type release. The cartridge-type water bomb has an expandable bladder fixedly attached to frontward and rearward portions of a main housing which effect a shut off valve in a passageway when the frontward and rearward portions are rotated relative to one another. The water gun has a gun housing and a cocking and engaging lever which accepts the cartridge-type water bomb against a nesting section connected by way of an exit tube to a discharge orifice at a gun barrel end. The pressurized water in the expandable bladder may be released by pulling a pinch trigger.

U.S. Pat. No. 5,850,941 to Johnson, et al. describes a toy water gun with an air siphoning valve. The water gun is provided with a pressure tank in fluid communication with a coupler adapted to be received upon a conventional water faucet, and a pump for conveying additional air to the pressure tank. The flow of water from the water faucet draws ambient air which is compressed within the pressure tank to pressurize the water therein. The pressurized liquid is released through a nozzle coupled to the pressure tank by actuation of a trigger.

U.S. Pat. No. 5,915,771 to Amron teaches a fluid-ejecting toy in which the fluid storage reservoir may be selectively charged either with pressurized water from a municipal water supply or, when a pressurized source of supply is unavailable, with unpressurized water that is subsequently pressurized within the reservoir via a manually operable pump. In an illustrative embodiment, the receptacle has a one way valve that allows only pressurized water to enter the receptacle. A variety of ways of charging the reservoir with unpressurized water may be employed. By way of example, the reservoir may be configured as a removable structure having a mating threaded engagement with an adapter incorporating the one way valve. The toy is provided with a manually operable pump for charging fluid received in an unpressurized condition.

U.S. Pat. No. 6,193,107 to D'Andrade discloses a toy water gun for containment and ejection of water which includes a housing, an ejection nozzle, a bladder and an outlet connection which runs from the bladder to the nozzle. The expandable bladder is located in the housing and has a first end connected to the outlet connection and has a carriage attachment located at the second end. The bladder carriage attachment is movable and guided generally linearly in the housing as the bladder is expanded. The bladder is a tubular member having a weakened section with a larger diameter than the remaining portion of the tubular member and has a variable diameter which varies from larger at the first end to smaller at the second end. In one embodiment, the bladder has a variable diameter, larger at it's front end and smaller at it's back end. In another embodiment, the bladder has a constant diameter with a wall thickness gradient. Combined variable diameters and wall thickness may be used.

U.S. Pat. No. 6,325,246 to Crawford, et al. describes a hand operated water gun which utilizes a base section which can be mounted on the upper arm of the user or carried by the user. The base section may include an elastic bladder and a pumping apparatus. The elastic bladder connects with a reservoir. The pumping apparatus is manually operated by a movable section which can comprise a handle. The movable section is pivotally mounted to the base section. Movement of the movable section causes water to flow from the reservoir into the elastic bladder causing the elastic bladder to expand. A discharge nozzle is connected to the elastic bladder with the discharge nozzle being normally closed preventing flow of water therethrough by a discharge valve. The discharge valve is to be manually openable to cause the dispensing of the water in the form of a stream. The water is to be supplied into the elastic bladder until it expands to a certain degree prior to opening of the discharge nozzle. A pressure relief valve is mounted in conjunction with the elastic bladder to help such from over expanding. Different configurations of fill valves may be used to fill the reservoir with water.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein.

SUMMARY OF THE INVENTION

The present invention provides a toy water gun apparatus including a gun housing having a water chamber inside a pressurized air chamber in fluid communication with the water chamber to form a closed system. The water chamber preferably includes an expandable bladder for filling with a quantity of water and has a first end and a second end, the first end connected to a water inlet for releasable connection to source of pressurized water such as a municipal water supply, and the second end connected to a nozzle valve. A trigger mechanism is connected to the nozzle valve to selectively open the valve to dispense a stream of water during play.

The inventive toy water gun utilizes the naturally high pressure of a common faucet tap while eliminating the necessity of constant pumping in order to maintain a desirable water stream. The improved water gun design is based on a pressurized air chamber—the pressure to which, once established, is never lost because it is sealed and entirely separate from the water-delivery mechanism.

The inventive water gun requires no pumping and delivers a greater stream velocity, volume and distance than the current 'pump driven' variety of water guns. In addition, the inventive water gun maintains a nearly constant pressure for its entire water capacity meaning the water stream won't lose range or volume while shooting.

The water chamber bladder is preferably made from a highly expandable elastic tubing. When the bladder, or expandable elastic tubing, is empty, the user simply refills the bladder with water via a convenient faucet connector attached to the water gun. The pressure from the faucet expands the elastic bladder, which re-pressurizes the water container.

The invention may also be configured as a refillable backpack, with one or a plurality of water bladders for extra capacity, based on the same engineering principles as the water gun. This would provide a greatly enhanced water supply for more continuous water-gun action with more play time between refills.

It is therefore an object of the present invention to provide a new and improved toy water gun apparatus.

It is another object of the present invention to provide a new and improved toy water gun that utilizes the naturally high pressure of a common faucet tap.

A further object or feature of the present invention is a new and improved toy water gun that eliminates the necessity of constant pumping in order to maintain a desirable water stream.

An even further object of the present invention is to provide a novel toy water gun that delivers a water stream that won't lose range or volume while shooting.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
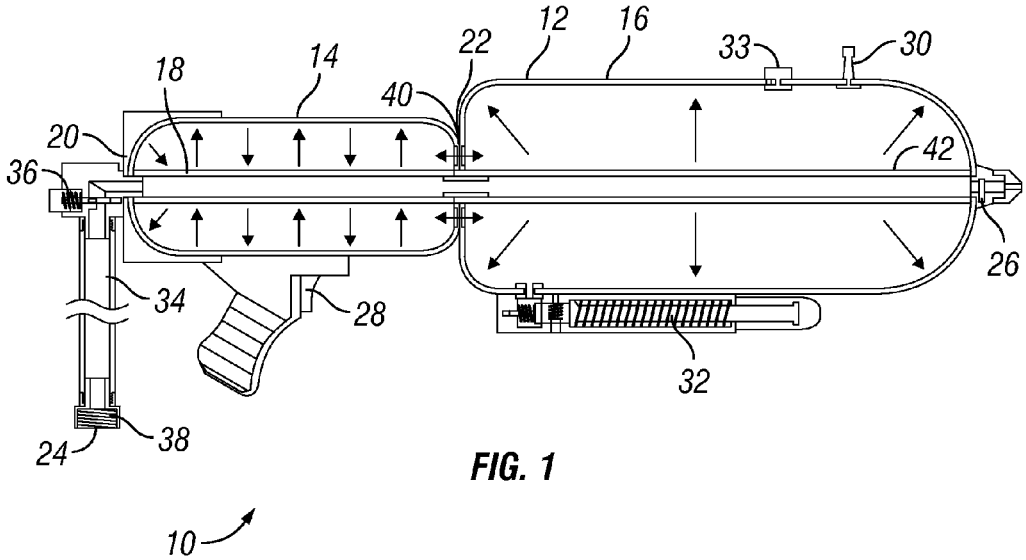
FIG. 1 is a side elevation cross-sectional view of a toy water gun apparatus of this invention when empty of water.
Figure 2:
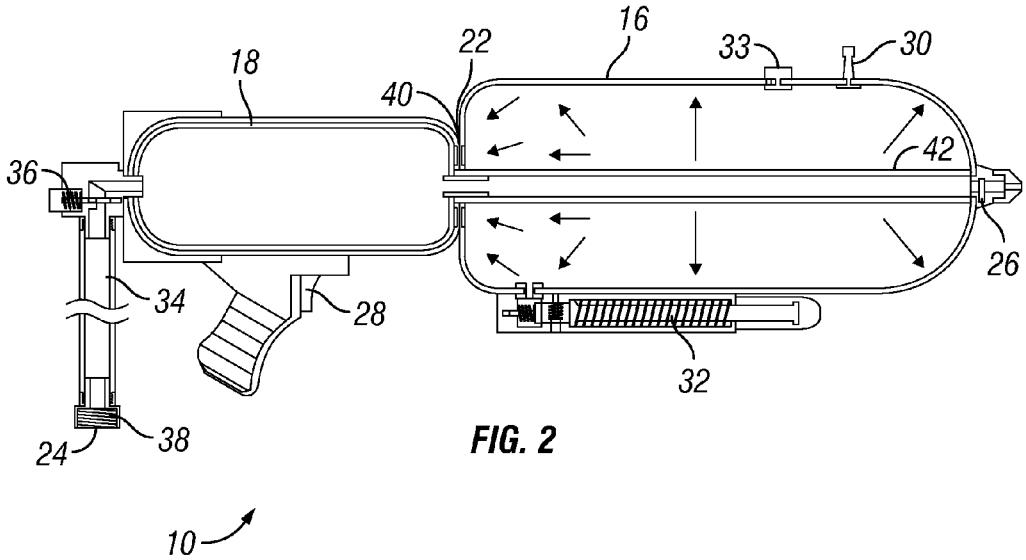
FIG. 2 is a side elevation cross-sectional view of the toy water gun apparatus with the expandable bladder of the water chamber having been filled with water and ready to dispense a stream of water through the nozzle.

Referring to FIGS. 1 and 2, wherein like reference numerals refer to like components in the various views, there is illustrated therein a new and improved toy water gun apparatus, generally denominated 10 herein. FIG. 1 illustrates a first preferred embodiment of the toy water gun apparatus 10 when empty of water, while FIG. 2 illustrates the apparatus having been filled with water and ready to dispense a stream of water during play.

Toy water gun 10 includes a gun housing 12 having a water chamber 14 and a pressurized air chamber 16 in fluid (air pressure) communication with the water chamber 14. The water chamber preferably includes an expandable bladder 18 for filling with a quantity of water, and has a first end 20 and a second end 22. The first end 20 is connected to a water inlet 24 for releasable connection to source of pressurized water such as a municipal water supply. The second end 22 is connected to a nozzle valve 26. A trigger mechanism 28 is mechanically connected to the nozzle valve 26 to selectively open the valve to dispense a stream of water during play, as is well known in the art.

Air pressure in the air chamber 16 can initially be established and adjusted via a simple bike pump through an air pressure valve such as a standard bike tire valve stem 30, built-in hand pump 32 on the water gun, or other source of pressurized air. The air chamber may also include a pressure release valve 33 for safety.

On the outside of the pressurized container the water inlet 24 preferably consists of a high-pressure water line 34 with an on/off valve or one-way check valve 36 that permits the pressurized water to fill the gun, but prevents backflow, and a female faucet connector 38 (which could be a quick-release connector type) for standard water faucets or hoses.

The interface between the water chamber 14 and pressurized air chamber 16 is at a perforated wall 40 of the pressurized container, which encloses the water bladder of highly expandable tubing. This permeable layer allows pressure to balance between the chambers, but contains the expandable tubing. The second end 22 of the water chamber may be connected to the nozzle valve 26 with non-expanding (rigid) high-pressure tubing 42 passing through the pressurized air chamber 16. Alternatively, the air chamber 16 could be configured on top of the water chamber 14 in an "over/under" arrangement, or around the water chamber, or in any other arrangement, so long as the air chamber and water chamber remain in fluid (pressure) communication with one another. For example, the expandable bladder could be retained within a high strength perforated wall or housing contained within the larger air chamber.

Average faucet pressure served by most municipal water districts is between 40 and 80 psi. This force flow is more than sufficient to cause the elastic tubing 18 to fill with water. If it is not, then user can reduce air chamber pressure, fill the water bladder, and then recharge the air chamber using any suitable method such as either pump method.

The elastic tubing's own restoring force coupled with the pressurized container works against the tubing expansion and results in a very great and constant outflow of water. If the user requires additional stream force, he/she can further increase the air chamber pressure. When the water bladder (expanded elastic tubing) is empty, the user only needs to refill the tubing at a water faucet, which establishes the acting force again.

In most cases the water bladder will fill to the limits of the water bladder chamber. In the rare case that the faucet pressure is lower than normal, the water bladder will fill with water up to the point where the combined forces from the internal pressure of the air chamber and the restoring force of the elastic tubing exceeds the water faucet pressure. If the water bladder does not fill sufficiently, then the user needs only to let some air out of the pressurized container (thereby reducing the combined forces). There is always the option of recharging the air chamber pressure after the bladder has been filled. Thus, the desired water stream is established once the user increases or decreases the air pressure of the container. However, once the ideal internal pressure is established on a given day, the user need never use the pump again and simply refills the water gun from a pressurized faucet tap.

It is not necessary that the elastic tubing used as the water vessel be elastic tubing, it could be a bladder made from another material. The air chamber creates the force needed for the water to evacuate the gun, and the elastic tubing facilitates this function, however other materials or shapes could be utilized.

Not only is this design superior to the 'Super Soaker' type water guns, it is a simpler design with fewer moving parts making it more durable and easier to manufacture. The overall size and shape of the inventive water gun can conform to a wide range of concepts and sizes as desired. For example, the water inlet may be configured at the front of the gun, and even coaxial with the nozzle valve, so that the water chamber may be refilled by inserting the water inlet into a pressurized water source such as a water "box" for quick refills. In this embodiment, the water gun is filled, and the water stream expelled, with the same aperture.

Additional features of the inventive apparatus may include, but are not limited to, the following:

Multifunction trigger: Center as opposed to top hinged to provide two functions; regular, full dump, short burst, long burst. Multi-step trigger: partial pull standard, next step dump, or combination of two trigger types. Three triggers stacked vertically, each with multi step variations.

Loading station adapters for attachment to the water inlet: hose thread, aerator thread, non-threaded.

Multifunction nozzles: Multi-stream fan, finer for distance, coarse for volume, left and right angle for shooting around corners, oscillating sweep or spiral; fogging nozzle; nozzle for filling balloons; or nozzle that launches foam projectiles.

Burst mode and/or user settable restrictor insures water won't be wasted during the heat of battle.

Variable or staged hand pump to quickly bring the air chamber to pressure (e.g., low pressure/high volume, then high pressure/low volume).

When the pump is utilized to charge the system, manual air vents may be used to speed dip loading or loading from drinking fountain, or a hose with a funnel adapter may be used to ease loading from inaccessible faucets. The pressure pump may double as a water pump to draw water into tanks from shallow streams or buckets.

Scalable system: 1, 2 or 3 tanks.

Magazine loading. Precharged tanks that snap on. Tanks can be charged by buddies during the heat of battle.

Food color chamber to color the water stream. Fluorescent coloring for play under black lights.

Clear tank or fill gauge so user knows how much water is left.

One design allows the user to manually fill the gun and then pressurize it with the hand pump. This will allow use of the gun when the "water companies" pump (municipal or other pipe pressure) is not available.

An internal perforated rigid tubing may facilitate the optimal mass flow of water from the water bladder during depletion.

The nozzle may include a laminar flow device to reduce turbulence, providing a clear, smooth exit stream of water. The nozzle may also include a device to regulate exit water pressure so that the exit stream is constant throughout the water bladder evacuation.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A toy water gun apparatus comprising:

a gun housing having a water chamber; said water chamber including an expandable bladder for filling with a quantity of water, a first end, and a second end, said first end connected to a water inlet for releasable connection to source of pressurized water, said second end connected to a nozzle valve;

a pressurized air chamber in bidirectional fluid communication with said water chamber; and a trigger mechanism connected to said nozzle valve to selectively open said nozzle valve to dispense a stream of water during play.

2. The toy water gun apparatus of claim 1 wherein said expandable bladder comprises elastic tubing.

3. The toy water gun apparatus of claim 1 wherein said pressurized air chamber includes an air valve for introduction of pressurized air.

4. The toy water gun apparatus of claim 3 wherein said air valve comprises a bike tire valve.

5. The toy water gun apparatus of claim 1 wherein said pressurized air chamber includes a built-in hand pump for introduction of pressurized air.

6. The toy water gun apparatus of claim 1 wherein said water inlet comprises a female faucet connector.

7. The toy water gun apparatus of claim 1 wherein said water inlet comprises a quickrelease connector.

8. The toy water gun apparatus of claim 1 wherein said water inlet comprises a check valve.

9. The toy water gun apparatus of claim 1 wherein said water chamber and said pressurized air chamber are separated by a perforated wall.

10. The toy water gun apparatus of claim 1 wherein said gun housing includes a safety pressure release valve.

* * * * *